US006709368B1

(12) United States Patent
Chue

(10) Patent No.: US 6,709,368 B1
(45) Date of Patent: Mar. 23, 2004

(54) FOOT EXERCISE DEVICE

(75) Inventor: Lap Fu Chue, Tai Po (HK)

(73) Assignee: Etna Products Co., Inc., New York, NY (US)

( * ) Notice: Subject to any disclaimer, the term of this patent is extended or adjusted under 35 U.S.C. 154(b) by 0 days.

(21) Appl. No.: 10/346,020

(22) Filed: Jan. 16, 2003

(51) Int. Cl.[7] ..... A63B 23/08
(52) U.S. Cl. ..... 482/79; 482/80; 482/52
(58) Field of Search ..... 482/79, 80, 53, 482/51, 52, 111–112, 72, 57–59, 62, 70

(56) References Cited

U.S. PATENT DOCUMENTS 5,062,627 A * 11/1991 Bingham ..... 482/53
5,199,934 A * 4/1993 Lin ..... 482/79
5,232,421 A * 8/1993 Chen et al. ..... 482/153
5,256,118 A * 10/1993 Chen ..... 482/53
5,277,677 A * 1/1994 Terauds ..... 482/53
5,865,712 A * 2/1999 Chang ..... 482/57
6,135,926 A * 10/2000 Lee ..... 482/57

* cited by examiner

*Primary Examiner*—Jerome W. Donnelly
(74) *Attorney, Agent, or Firm*—Lilling & Lilling P.C.

(57) ABSTRACT

Requiring no special ability, this exercise devise can be used by anyone for simulating walking, while sitting down. Consisting of two pedals that move in opposition to one another as one foot presses down, while the other is pushed up, the device is placed under your feet while sitting in a chair. By turning clockwise a resistance dial located on a stem, resistance is adjustable by the user. A straight metal axle at the rear of the device serves as an axis about which two pedals rotate and furnishes support through the attached feet. Mechanism of resistance is provided by opposition against two arc shaped wedges offset by an angle resulting in one pedal rising as the other falls. Each end of a curved axle in the front provides support. The straight axle in the back is connected to the curved axle in the front by a central housing on top of which is positioned the resistance dial.

11 Claims, 6 Drawing Sheets

FOOT EXERCISE DEVICE

FIELD OF THE INVENTION

The invention relates to exercise equipment and, in particular, to an inexpensive stepping machine that requires no assembly, no batteries, and no cords.

BACKGROUND OF THE INVENTION

The marketplace overflows with exerciser inventions, such as steppers that provide exercises for leg, calf and/or ankle muscles. To the user of these devices will inure fitness as well as the expense of the exercise device. Strenuous and beneficial exertions in using these other devices are usually mitigated by the user abandoning the effort. Lack of portability is a key reason that exercisers do not use the device. One of the prime reasons that people give for not exercising is that they have no time.

In today's fast moving times, people are always on the move. Finding time to exercise is just another of the time consuming activities that busy people cannot always fit into their schedules.

What people need is a simple, portable device, they can stick under their desk or chair, and which they can use when they are talking on the phone, reading, surfing the Internet or any of other myriad business, personal and social activities. By always being available, such a device makes it possible for today's 21$^{st}$ century active person to engage in his normal hectic schedule, but still be able to regularly engage in a systematic regimented exercise routine.

Fulfilling a need for exercising leg, calf and/or ankle muscles, the instant invention provides simplicity and facility in operation. An inexpensive invention that impels those who have difficulty walking or who are recovering from certain injuries to want to use it enhances their well being physically.

Numerous advantages accrue to the user. The invention improves the circulation and helps relieve pain and swollen ankles. Edema follows tissue injury or trauma, resulting in pain as the liquid is pressed against the nerves. By simulating the walking action, leg muscles are stimulated to contract, the effect of which is to enhance venous and arterial blood flow removing some of the liquid. Exercising by stretching the calf and ankle muscles improves their strength, increases their range of motion and reduces the pain, providing a much sought after benefit.

Being portable and lightweight, the device may be used just about any place your feet are resting. At home while watching TV or reading, your feet are kept nimble. Outdoors on the patio or at the beach, your ankles feel invigorated without the strain of jogging. In hotels, buses, trains, or planes, not only adults, but also your children, will never make excuses of being bored by inactivity.

A multitude of users will benefit from the walking action. The device is perfect for office workers, teachers, students, expectant moms, travelers, and athletes. People can do the exercise walk while working at their desks. Students can exercise while doing their homework. Expectant moms will be thrilled to be able to exercise without overexerting themselves or without fear of injury. Travelers should be able to avoid sores from stagnation before reaching their destination. Athletes can specifically strengthen their ankle muscles without strain.

SUMMARY OF THE INVENTION

The object of this invention is to provide for the benefits of walking while sitting. Individuals who sit down for extended periods of time succumb to the ill effects of prolonged stagnation, poor circulation, and swollen ankles. To the user of the device are conferred the benefits of the action of walking, including enhanced flexibility of ankles and diminished edema of swollen ankles. Availing those who have difficulty walking, the device promotes calf, ankle and foot movements that bring about greater fitness and relief.

Constructed with rugged materials, the device features two movable levers that rotate on the same axis in opposite direction with respect to one another, rising and falling so that as one foot presses down on one lever, the other lever pushes the other foot up. There are two transverse axles, a front axle and a rear axle, connected by a longitudinal housing that characterize the frame of the assembly. Providing an axis for rotation for the levers, the rear axle also has two feet at the ends for support. The curved front axle with its two feet serves not only as support but also as a barrier to further downward motion by each lever. Besides support, the role of the longitudinal housing is to unite the two transverse axles together into a single body.

DETAILED DESCRIPTION OF THE INVENTION

Figure 1:
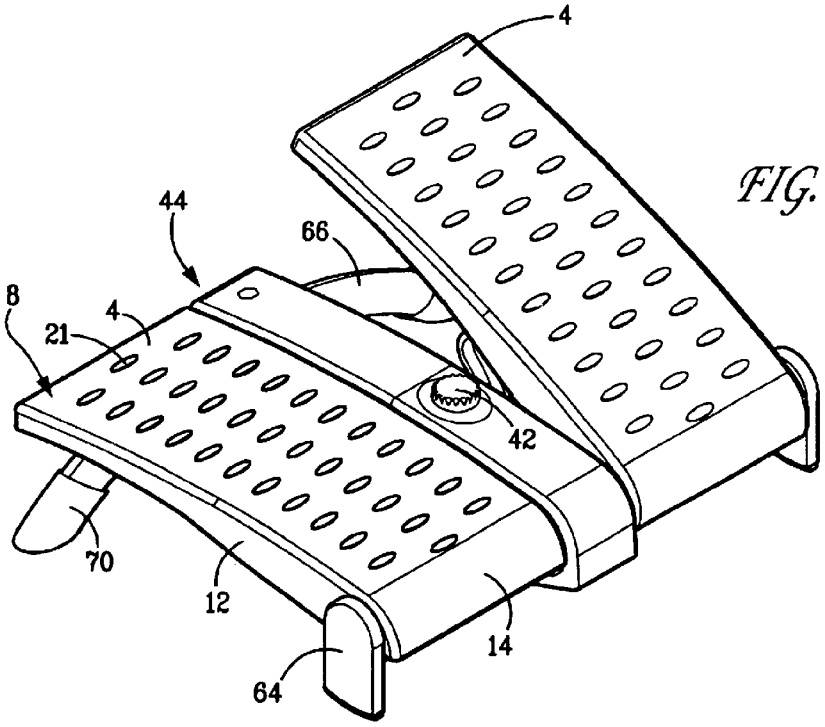
FIG. 1 is a top perspective view of the foot exercise device.
Figure 2:
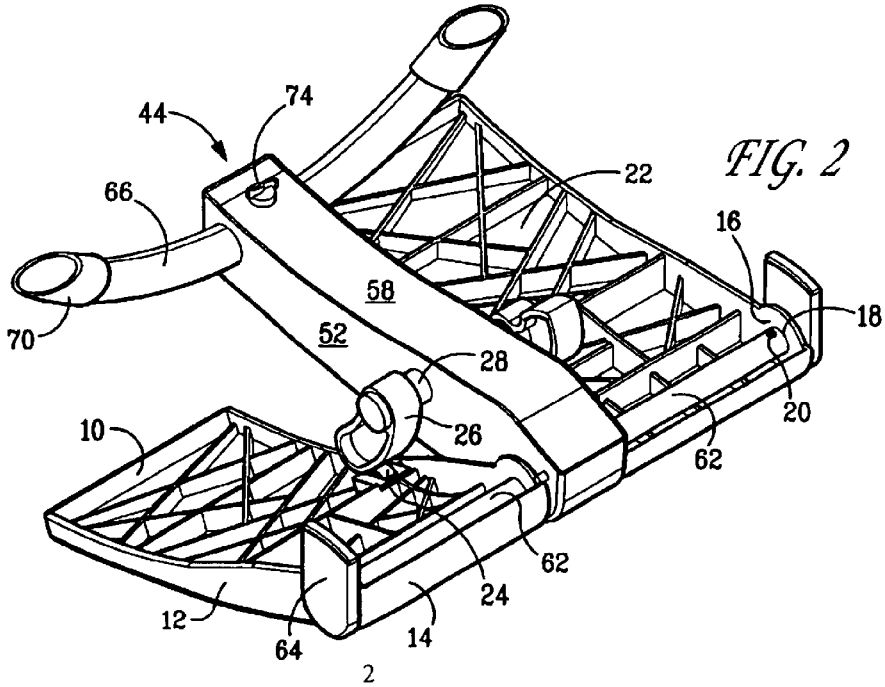
FIG. 2 is a bottom perspective view of the foot exercise device.
Figure 3:
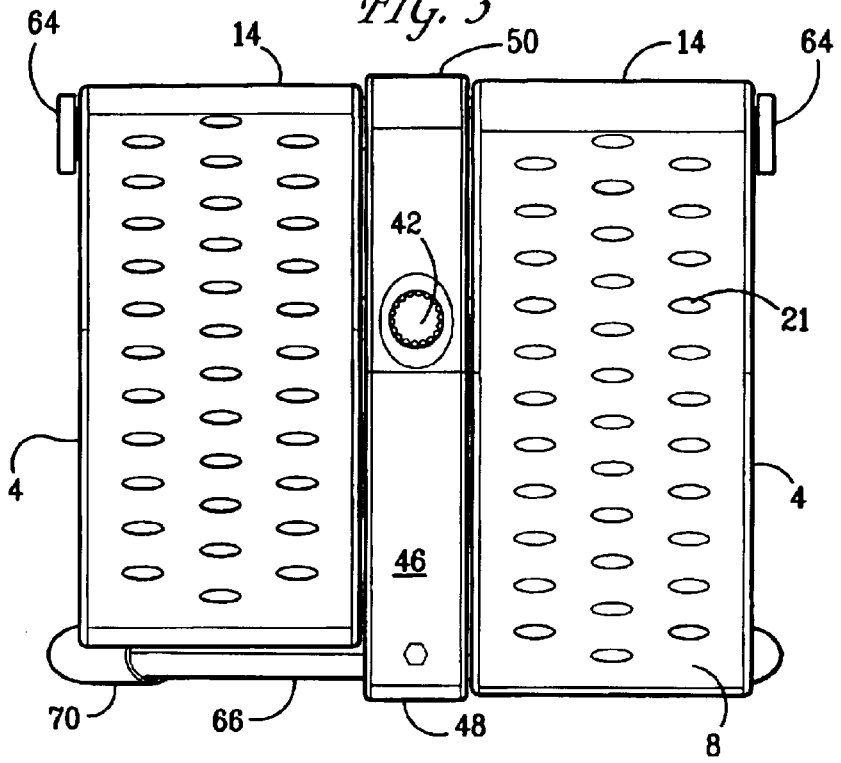
FIG. 3 is a top view of the foot exercise device.
Figure 4:
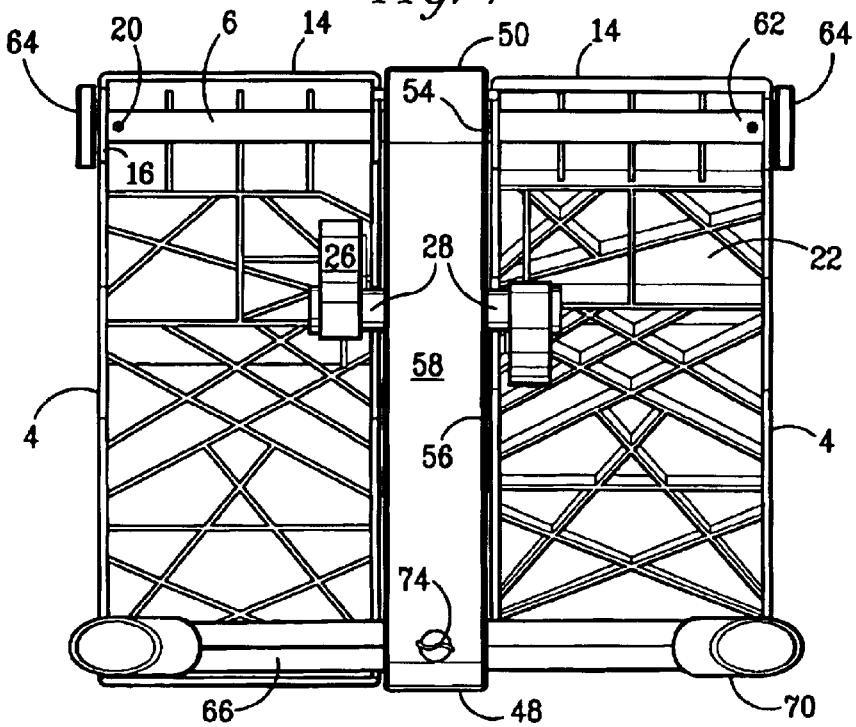
FIG. 4 is a bottom view of the foot exercise device.
Figure 5:
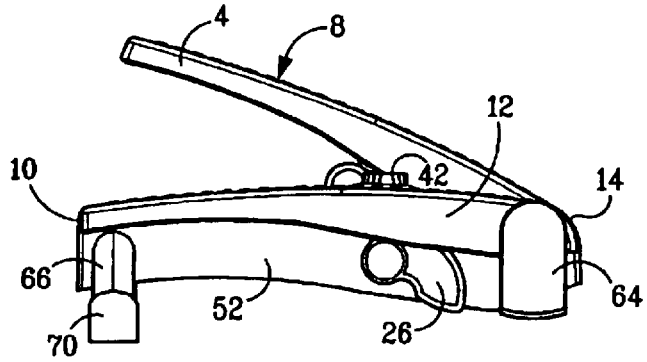
FIG. 5 is a right view of the foot exercise device.
Figure 6:
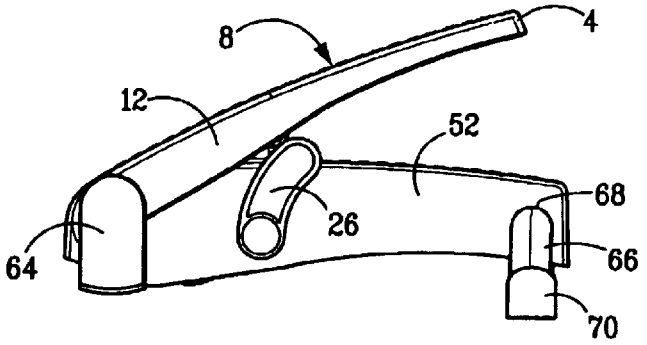
FIG. 6 is a left side view of the foot exercise device.
Figure 7:
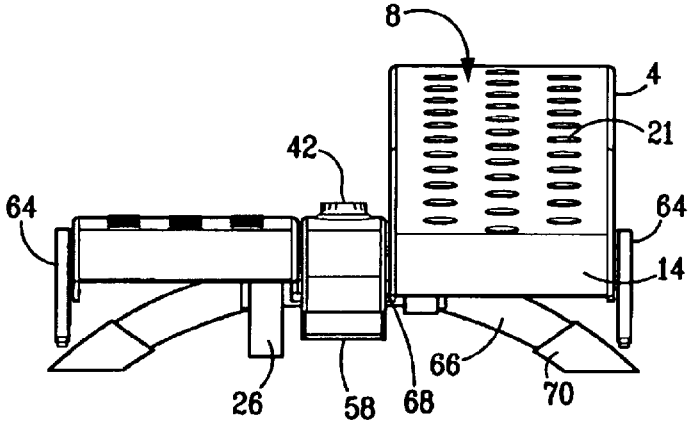
FIG. 7 is a rear view of the foot exercise device.
Figure 8:
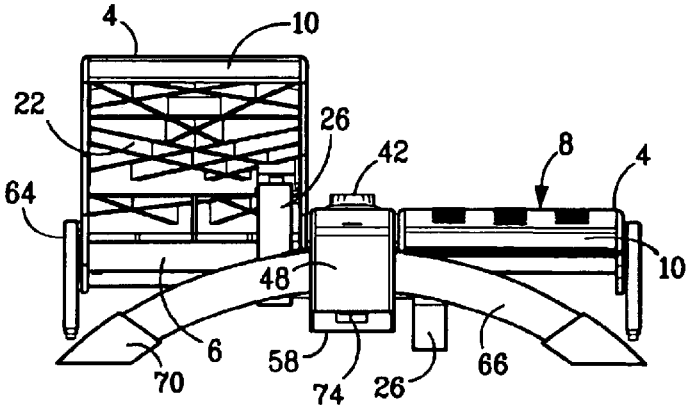
FIG. 8 is a front view of the foot exercise device.
Figure 9:
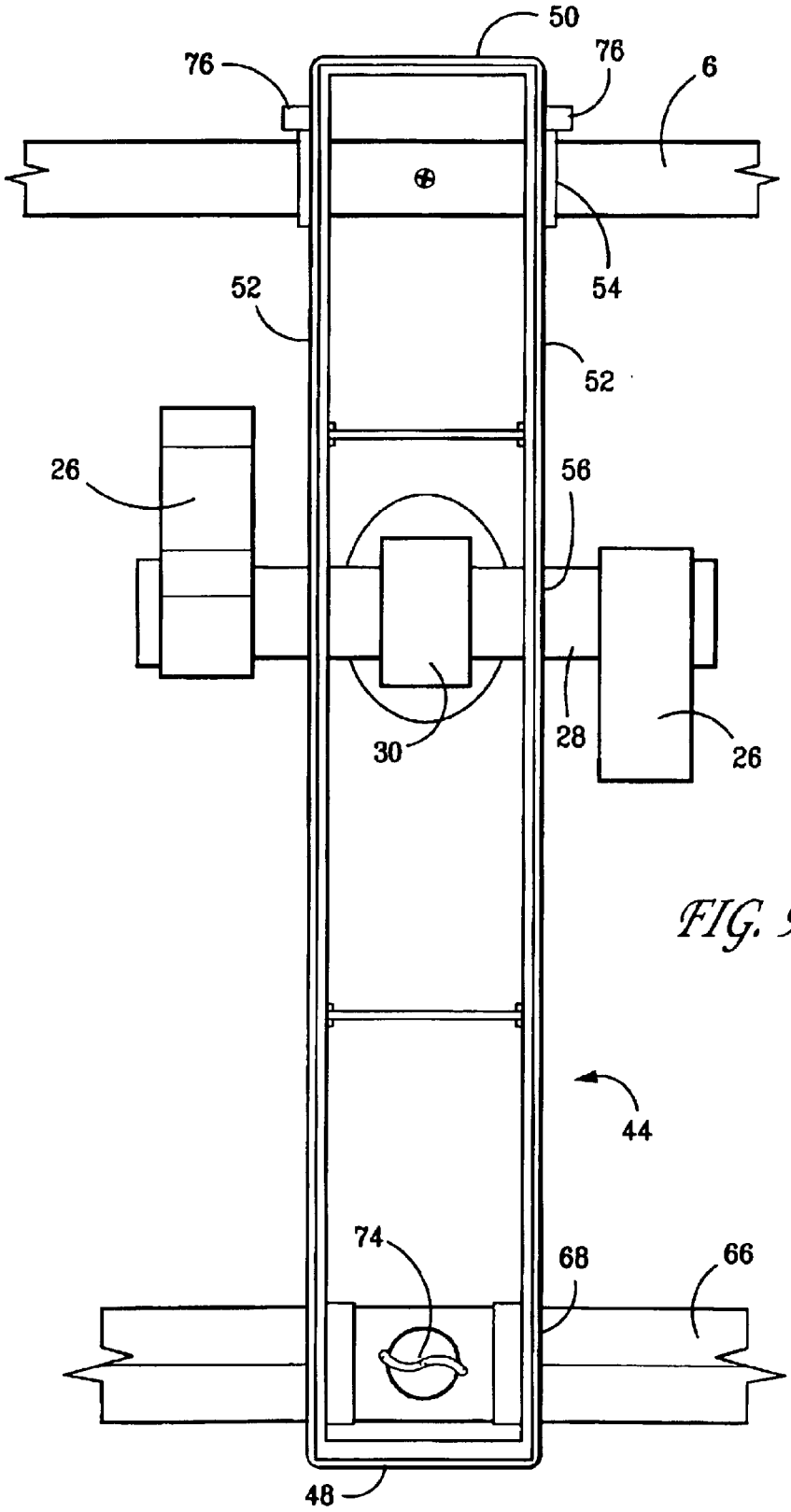
FIG. 9 is an enlarged bottom view of the foot exercise device with the cover of the housing removed.
Figure 10:
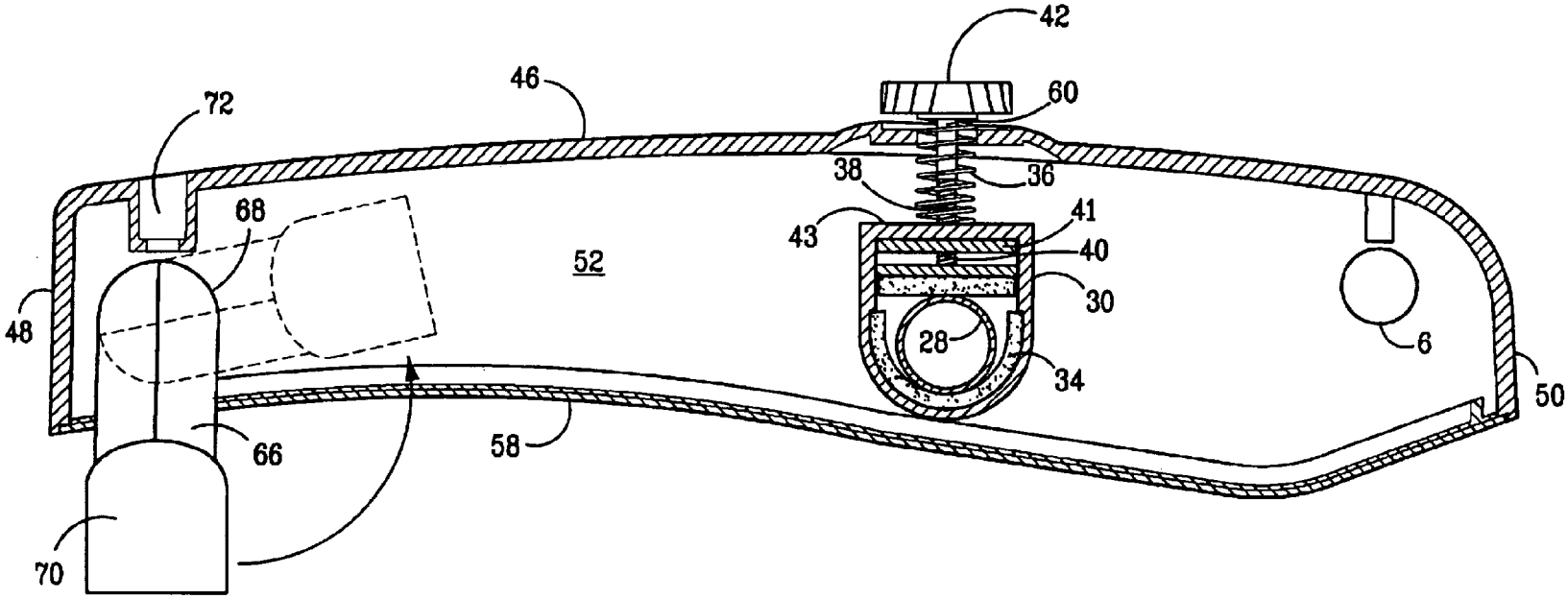
FIG. 10 is a side view of the housing with the side panel of the housing removed.
Figure 11:
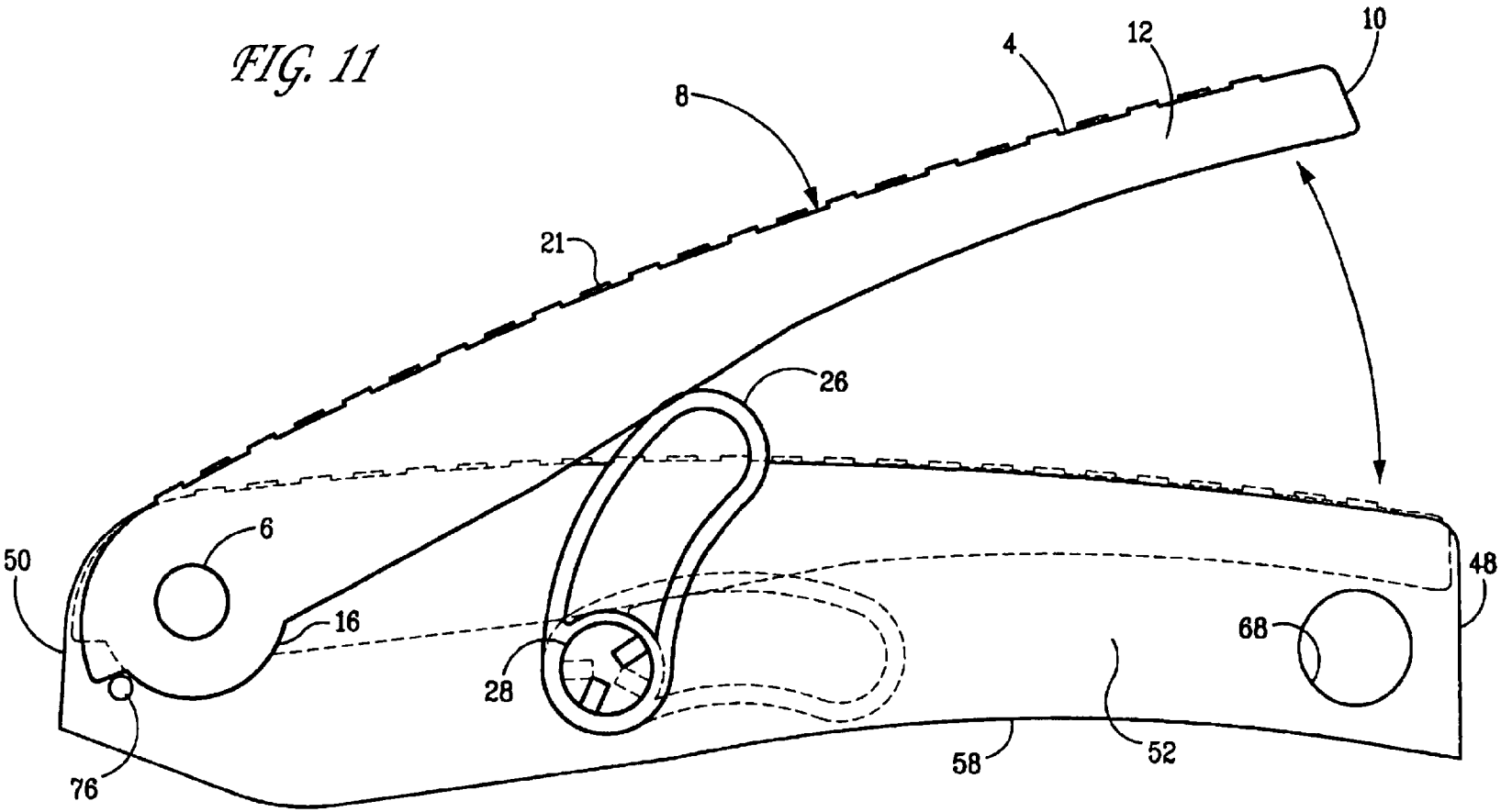
FIG. 11 is an enlarged side view, showing the action of the pedal.

As shown in the preferred embodiment, the herein Foot Exercise Device has two steps 4 (i.e. pedals or levers), as the exerciser is of the stair or step variety. First one foot presses down on one step, as the other step rises. Then, the other foot pushes down on the other step, and the stepping motion is reversed. Variable resistance in the form of minilevers is provided.

The present invention is shown in the preferred embodiment in which the rise and fall of the levers or steps 4 is accomplished by rotation about a rear transverse axis 6. Each lever or step is of generally rectangular configuration and is designed to conform to the size of the user's foot. It needs to be wider than the average foot, as well as longer than the average foot. In this way, the foot will be retained securely on the surface of the step, and will not fall off during exercise. Similarly, the steps cannot be too big or they will be awkward to use and may offer too much resistance to exercise.

Each step 4 has a top surface 8 on which the feet press. Then, there are also front, side and rear panels 10, 12 and 14 to define the completed step. They are made together in one integral unit, preferably of plastic, but any sturdy material may be used. At the rear end of the side panels 12, two support ears 16 are defined. In each of the ears, an opening 18 is made. The axle 6 fits snugly through these openings, so that the axle will rotate as the step moves up and down. Setscrews 20 may optionally be provided in the axle to prevent lateral movement of the step or lever. Further, the two steps are set at different angles on the axle, so that as one step moves up or down, the other step (due to its fixation on the axle) moves in the opposite direction. Ridges or protrusions 21 may be made on the top surface 8 of the pedals, so the feet do not slip during exercise. Alternatively, a non-slip material may be coated on the pedal.

On an undersurface 22 of each step 4, a bearing abutment 24 is provided for engagement with the resistance mechanism, as hereinafter described. The resistance mechanism bears directly on the bearing abutment 24 on the undersurface of each step, so as to provide a variable resistance load to vary the exercise.

In the preferred embodiment, the resistance mechanism is implemented by two curved minilevers 26—one for each step. Each minlever is wing-shaped and is fixedly mounted on an axle 28, so that the axle moves with the mini-levers. Centrally located along the axle 28 is a brake housing 30. The brake housing itself may be made of any material, such as rubber, but within its central opening 32 there is a ring or band 34 of resistive material. A spring 36 acts against brake housing 30. As the spring is compressed, it exerts more pressure on the brake housing and causes the ring of resistive material to bear more heavily against the axle, thereby requiring more force to move the axle and minilevers, thereby effectively increasing the resistance for the pedals.

To adjust the tension of the spring 36, a threaded screw 38 is provided. The distal end 40 of the screw passes through an opening in the top surface 43 of the brake housing 30, and threads into a nut plate 41 to provide a locking engagement. At the other end of the screw is an enlarged head 42 to facilitate turning the screw. If the screw is turned clockwise, the screw is threaded into the brake housing, compressing the spring and increasing the effective tension. Rotation in a counter-clockwise fashion causes the screw to recede and decompresses the spring, reducing thereby the friction and resistance.

The axle 28 itself passes through the longitudinal axis of the device and is preferably about ¾ of the distance from the front of the unit.

This movement of the levers simulates walking action in which the user raises and lowers his feet. Each foot steps onto a lever, while the user is sitting down. Movement is initiated by pushing down with either foot. Only one foot can lower or rise at a time. In an alternative embodiment, as long as the assembly provides for a rotating motion of feet about ankles while sitting down, it simulates the walking action that is within the scope of the same invention.

A central housing 44 is preferably provided and it includes a box-like structure with a top 46, front 48, rear 50 and side 52 panels. Near the rear panel 50, the two side panels 52 have aligned openings 54 for passage of the axle 6 on which the pedals are mounted. Closer to the middle of the central housing, the side panels 52 have a second set of aligned openings 56 for passage of the axle 28. A removable cover 58 may be fitted over the bottom of the housing.

The aforementioned resistance structure with the axle 28, brake housing 30 and spring 36 are positioned within the interior of the housing 44. An opening 60 in the top surface 46 of the housing provided a means for the end of the screw 38 to extend out of the housing. The enlarged head 42 for the screw resides on the outside of the housing, so it can be conveniently turned by the user.

Any sturdy lightweight metal may be used for the two axles. Fabricated with strong durable plastic, the levers rotate as arms swing about their shoulder joint. The housing is produced from a strong durable plastic; and, the housing connects the rear transverse axis of the shoulder with the front transverse axis.

At the distal ends 62 of the axle 6, feet 64 may be provided to offer stability for the exercise device. For front stability, a front axle 66 may pass through aligned openings 68 in the housing. This axle 66 may be bent so that its ends 70 define feet on which the device is supported. In a preferred embodiment, the axle is curved or bowed and has a threaded opening in a central portion. A locking screw 74 passes through a hole 72 in the top of the housing and into the axle to hold the axle firmly in place. By rotation of the screw, the screw becomes disengaged from the axle and the axle can be laterally turned. This allows the axle to rotate to a storage position, so the unit can lay flatter.

To prevent the pedals from flipping over as they rise, the central housing also bears two knoblike protrusions 76. To prevent the pedals from sinking into the ground, the front axle stops the pedals from lowering any further, keeping it at the same elevation as the central housing when lowered. In the preferred embodiment, the knoblike protrusions and the front axle serve as barriers to define the range of stretching motion for the arch and ankle of the foot.

The invention is described in detail with reference to a particular embodiment, but it should be understood that various other modifications can be effected and still be within the spirit and scope of the invention.

I claim:

1. A portable exercise device for use by a sitting exerciser, comprising:

a. a central housing having multiple sets of aligned openings;

b. a first axle passing through a respective set of aligned openings in said housing;

c. a pair of reciprocating pedals fixedly mounted on said first axle, wherein vertical movement of each of said pedals rotates said axle and said pedals are set at different angles with respect to said first axle;

d. a second axle passing through a second set of aligned openings in said housing;

e. a of pair reciprocating minilevers fixedly mounted on each end of said second axle, whereby down movement of one of said pedals causes rotation of a respective minilever and consequent rotation of said second axle; and f. resistance means positioned in said housing and interacting with said second axle for adjusting the force to rotate said second axle, whereby the effective resistance for each pedal is adjusted concomitantly.

2. A portable exercise device according to claim 1, wherein said resistance means includes a bushing mounted on said second axle within said housing and a biasing spring forcing said brake housing against said second axle.

3. A portable exercise device according to claim 1, further comprising support feet being provided on distal ends of said first axle.

4. A portable exercise device according to claim 1, further comprising a third axle passing through a third set of aligned openings in said housing and support feet being provided on distal ends of said third axle.

5. A portable exercise device according to claim 2, further comprising support feet being provided on distal ends of said first axle.

6. A portable exercise device according to claim 2, further comprising a third axle passing through a third set of aligned openings in said housing and support feet being provided on distal ends of said third axle.

7. A portable exercise device according to claim 3, further comprising a third axle passing through a third set of aligned openings in said housing and support feet being provided on distal ends of said third axle.

8. A portable exercise device according to claim 5, further comprising a third axle passing through a third set of aligned openings in said housing and support feet being provided on distal ends of said third axle.

9. A portable exercise device according to claim 2, wherein said resistance means further includes a ring of resistive material within said bushing and said second axle bears against said ring.

10. A portable exercise device according to claim 9, wherein said resistance means further includes a screw means, and a nut plate positioned within said bushing and bearing against said second axle, a first end of said screw means engaging said nut plate to cause said nut plate to press said second axle against said ring of resistive material, wherein compression of said spring alters the force of the nut plate pressing said second axle against said ring of resistive material.

11. A portable exercise device according to claim 10, wherein said screw means has a second end with an enlarged head to permit an exerciser to rotate said screw to adjust the force of the second axle bearing against the ring of resistive material, thereby effectively adjusting the tension of the exercise device.

* * * * *